US007850114B2

(12) United States Patent
Lavy

(10) Patent No.: US 7,850,114 B2
(45) Date of Patent: Dec. 14, 2010

(54) SANITARY DOOR HANDLE

(75) Inventor: Meron Lavy, London (GB)

(73) Assignee: Sanicle Ltd., London (GB)

( * ) Notice: Subject to any disclaimer, the term of this patent is extended or adjusted under 35 U.S.C. 154(b) by 0 days.

(21) Appl. No.: 12/313,282

(22) Filed: Nov. 19, 2008

(65) Prior Publication Data

US 2009/0145992 A1 Jun. 11, 2009

(30) Foreign Application Priority Data

Dec. 7, 2007 (GB) ..... 0724045.0

(51) Int. Cl.
*B65H 18/08* (2006.01)

(52) U.S. Cl. ..... 242/538; 16/904; 49/460

(58) Field of Classification Search ..... 242/383, 242/383.2, 383.3, 383.4, 538, 538.1; 16/412, 16/904; 312/34.1; 49/460
See application file for complete search history.

(56) References Cited

U.S. PATENT DOCUMENTS 4,007,954 A * 2/1977 Erickson ..... 292/165
4,046,508 A * 9/1977 McDonald ..... 4/222
4,137,805 A * 2/1979 DeLuca et al. ..... 83/345
4,566,648 A * 1/1986 Hefty et al. ..... 4/243.3
4,658,469 A * 4/1987 Hawkins ..... 16/412
4,997,139 A * 3/1991 Menard ..... 242/535
5,403,047 A * 4/1995 Walls ..... 292/173
RE36,209 E * 5/1999 Walls ..... 292/173
6,196,599 B1 * 3/2001 D'Hooge ..... 292/165
6,237,805 B1 * 5/2001 Katsanevas ..... 221/45
6,645,435 B2 * 11/2003 Dawson et al. ..... 422/110
7,249,395 B2 * 7/2007 Brammer et al. ..... 16/412
7,716,789 B1 * 5/2010 Zevallos ..... 16/412
2007/0241125 A1 * 10/2007 Muderlak et al. ..... 221/71

* cited by examiner

*Primary Examiner*—Michael R Mansen
*Assistant Examiner*—Juan J Campos
(74) *Attorney, Agent, or Firm*—Brooks, Cameron & Huebsch PLLC

(57) ABSTRACT

This invention relates to a flat sanitary door handle mechanism incorporating a self-contained mechanical user-operated continuous material advancing system whereby the person touches a fresh length of material while using the flat door handle to open the door thus avoiding hand exposure to the surface of the flat handle which may have been contaminated by previous users. This is achieved by the pull and release of the flat door handle by the user, without any external source of power, the action of which replaces the used length of material with a fresh length and makes the handle ready for use by the next person.

5 Claims, 5 Drawing Sheets

SANITARY DOOR HANDLE

BACKGROUND OF THE INVENTION

This invention relates to a sanitary door handle whereby a manual user-operated mechanical advancing mechanism replaces position of a continuous thin paper/film on the handle thus user hands do not come into contact with potentially contaminated area touched by previous users.

Contaminated door handles have been a source of transfer of bacteria, germs and potential diseases, especially in areas of high human traffic such as public toilets, hospitals and restaurants to name a few. Most public toilet doors open inwards for safety reason, therefore the person entering the room does not necessarily have to touch any surface, and however the person exiting the room has to pull on a handle to open the door. A door, which can only open in one direction, cannot be opened without a handle and therefore it becomes contaminated by the users and human-to-human transfer of germs and diseases is inevitable.

Several designs for sanitary door handles, gloves and tissues for handling potentially contaminated door handles have been proposed over the years. For example application number GB2418857 by Wyen George James introduces a door handle, which sprays disinfectant on the door handle as it is operated on and claims to improve personal and public hygiene. However, this relies on a mechanism to spray the liquid on the surface of the handle, which may leave an undesirable as well as unexpectedly wet surface for the next user. The spray methodology cannot remove filth or other undesirable sediment from the surface left by users.

Davis Trevor Charles Edward (application number GB2387542) proposes a transparent handle incorporating a switch whereby an ultraviolet light is shined from within it and hence sterilises the surface. It requires external power to illuminate the UV light. And, again it has the drawbacks of the previous invention mentioned and its effectiveness is questionable.

U.S. Pat. No. 6,789,695 by G Benjamin presents a door handle, which is covered by a dispensable tissue—the tissue is dispensed from the hanging holdall on the door and covers the door handle. The user pulls a fresh tissue, which acts as a barrier between the hand and the handle and once the door is opened discards the tissue in a small receptacle or bin. This system relies only on proper use, is over-simplified and the holdall may not accommodate all the discarded tissues.

U.S. Pat. No. 6,289,557 by Manson Barry F et al is a handle bar in the form of a loop. It is claimed the user can operate it with the wrist or forearm. It appears to be a bulky handle bar and its safety is questionable in high traffic public places so is its ease of usage and safety when handled by untrained passing persons as well as the disabled.

With regards to the state of the art and relevance to the present invention, Hawkins F (U.S. Pat. No. 4,658,469) filed an application for a door handle, which incorporates a material advancing system activated by a sensor detecting approaching hands. The mechanism is motorized using batteries as a source of power. It appears to be a very elaborate system with not-so-easily replaceable paper reels and some other drawbacks; the paper whilst in use does not cover the whole of the handle leaving some area exposed to hands hence defying its objective.

The patent application by Muderlack et al (US2007/0241125 A1) presents a door handle material advancing system that has the versatility that, when mounted on a door, its handle can be grasped and used in different aspects. It is also claimed to have a dual-use handle sanitary cover refill cartridge for supplying and collecting used material to aide loading of such a cartridge inside the handle's casing. However, on close inspection of the patent description it appears that complications related to loading of the sanitary covered handle relay onto the main handle core still remain. Although extensively described and illustrated in this application, it's unclear as to how the cover material or the said handle relay, when in place, can cover the majority of the handle area grasped by hand. Furthermore, the proposed system adopts a rather elaborate sensor-activated motorized handle cover advancing and cover material metering device. The system has the advantages noted above but it is believed that from the maintenance, practical and logistical point of view it's usage may be limited.

SUMMARY OF THE PRESENT INVENTION

The objective of this invention is to introduce a door handle mechanism of simple construction and requiring minimum maintenance whereby each time the handle is pulled to open the door and released, a fresh length of paper/film (which essentially acts as a barrier between the hand of the user and the door handle) replaces the one used by the previous user, hence the next user's hand will be exposed to a fresh barrier paper/film and not the handle bar itself. In this way, the spread of bacteria, germs and potential diseases between users will be minimised. The self-contained continuous material mechanical advancing mechanism is manually activated by the user's pull and release of the handle hence eliminating the need to use any electrical motorization and source of power. It is hoped that this invention will find viable market in public toilets, hospitals, restaurants, or other places for opening and closing of doors and cabinet doors where sanitary consideration is of importance.

DESCRIPTION OF THE PREFERRED EMBODIMENT

The invention is now described in detail with reference to the accompanying figures.

Figure 1:
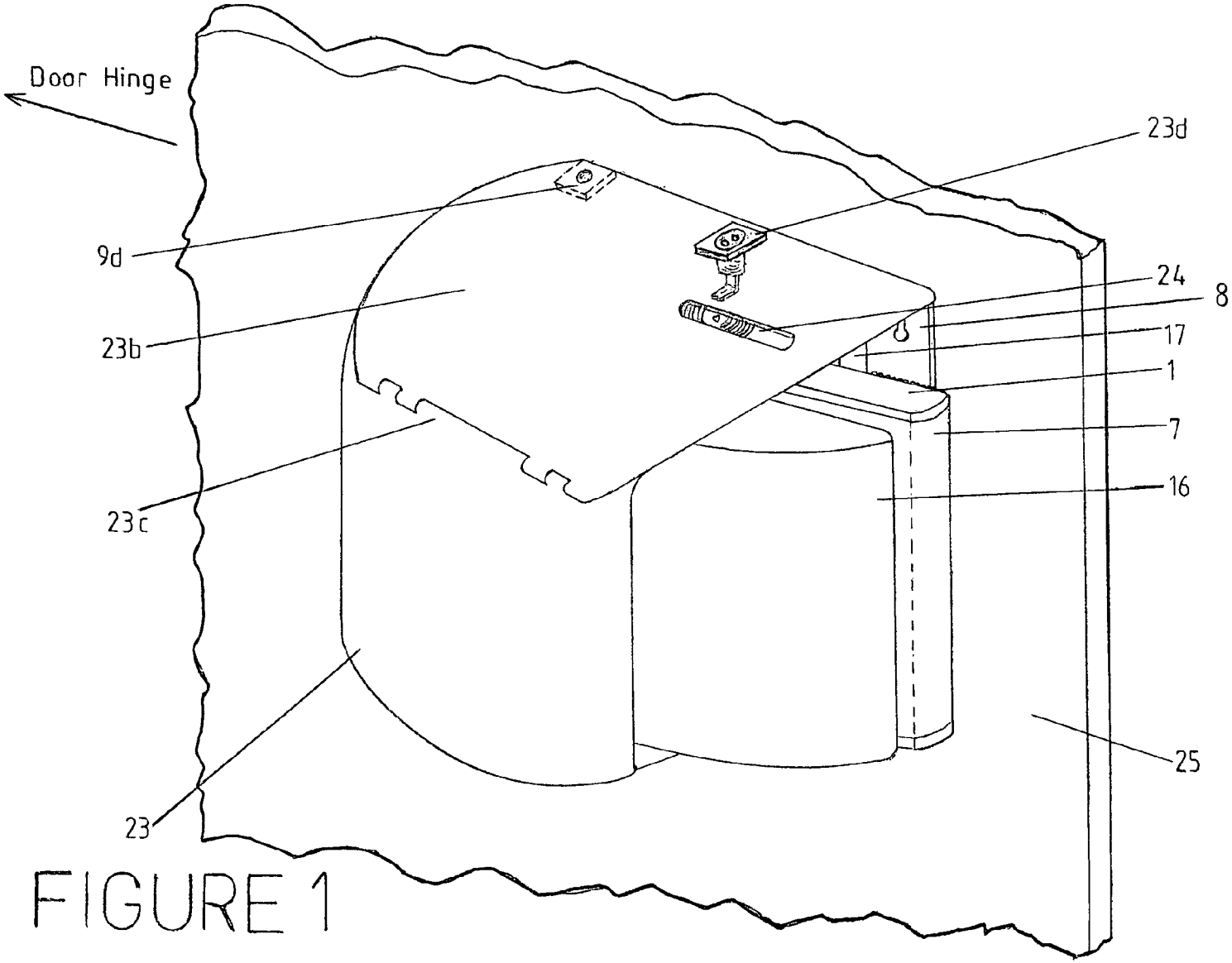
FIG. 1 OVERALL VIEW OF THE FLAT DOOR HANDLE AND ITS CASING

Referring to FIG. 1, the mechanism consists of a flat door handle bar (1) that is covered by a length of paper/film (7) from the reel in the area most likely to be touched by the user's hand. When the user touches the handle, the paper/film acts as a barrier between the hand and the flat door handle. When the user pulls the handle to open door (outwards from paper on the drawing), the force will open the door (25), which is partly shown here. The user releases the door handle and exits. The door handle moves back to its original position and whilst doing so, a fresh length of paper/film is dispensed from the feed reel and replaces the one used and makes the handle ready for the next user.

Figure 2:
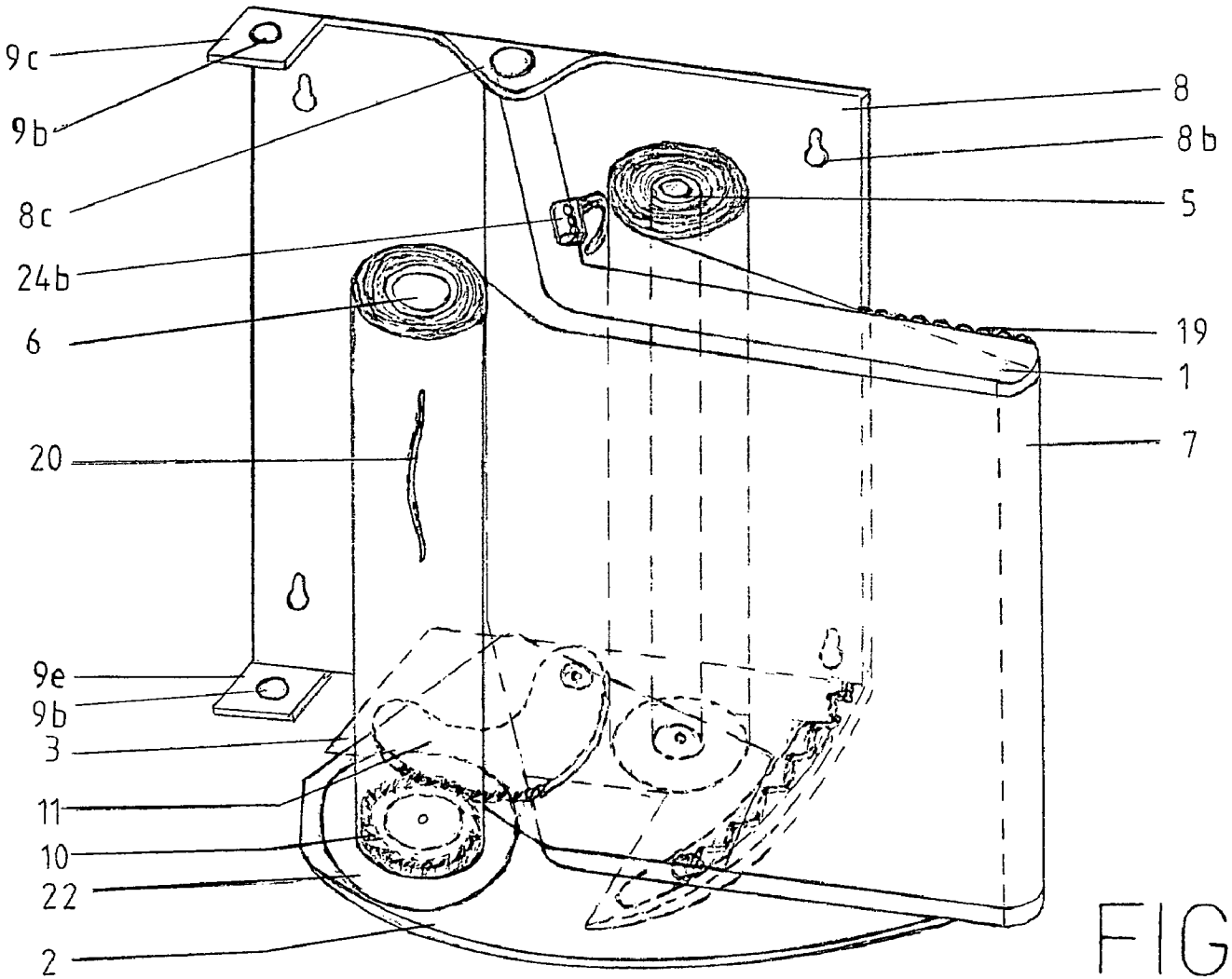
FIG. 2 DETAILED EXPLODED PERSPECTIVE VIEW OF THE FLAT DOOR HANDLE MECHANISM

With reference to perspective view in FIG. 2 and FIG. 1, the mechanism consists of a flat door handle (1) that is a formed thin plate or of solid construction with at least one flat side. This shape of handle that is shown by way of example and is not limited to, is to create an ergonomic surface for hand contact and for paper/film to run over it. The handle (1) is attached onto a base (2) that is in turn mounted such as to pivot on a flange (3) and flange (8*c*) both of which are part of the mounting bracket (8). There is a feed spool (5) that holds a reel of thin non-absorbing biodegradable paper/film (7), and a take-up spool (6) that is of a different diameter to (5) for the reasons explained later. The mechanism is attached to door mounting bracket (8) that can be mounted on the door via bolt holes (8*b*). A casing labelled (23) in FIG. 1, slides over the mechanism and, with the exception of the protruded part of the handle and hand shield, conceals the components within it. Bracket (9*d*) on the edge of the casing fits over bracket (9*c*) and secures it via bolt fitted through hole (9*b*) to the door mounting bracket (8). Similarly, brackets (9*e*) secure the casing to the door bracket at the bottom. With the casing in position, only part protruded handle bar and hand shield are exposed for use. The casing's top panel (23*b*), which is hinged (23*c*) to the front of the casing, acts as an access port for the internally mounted spools and will be described later. This hinged panel is secured and locked to the mounting bracket flange (8*c*) by a camlock (23*d*).

Figure 3:
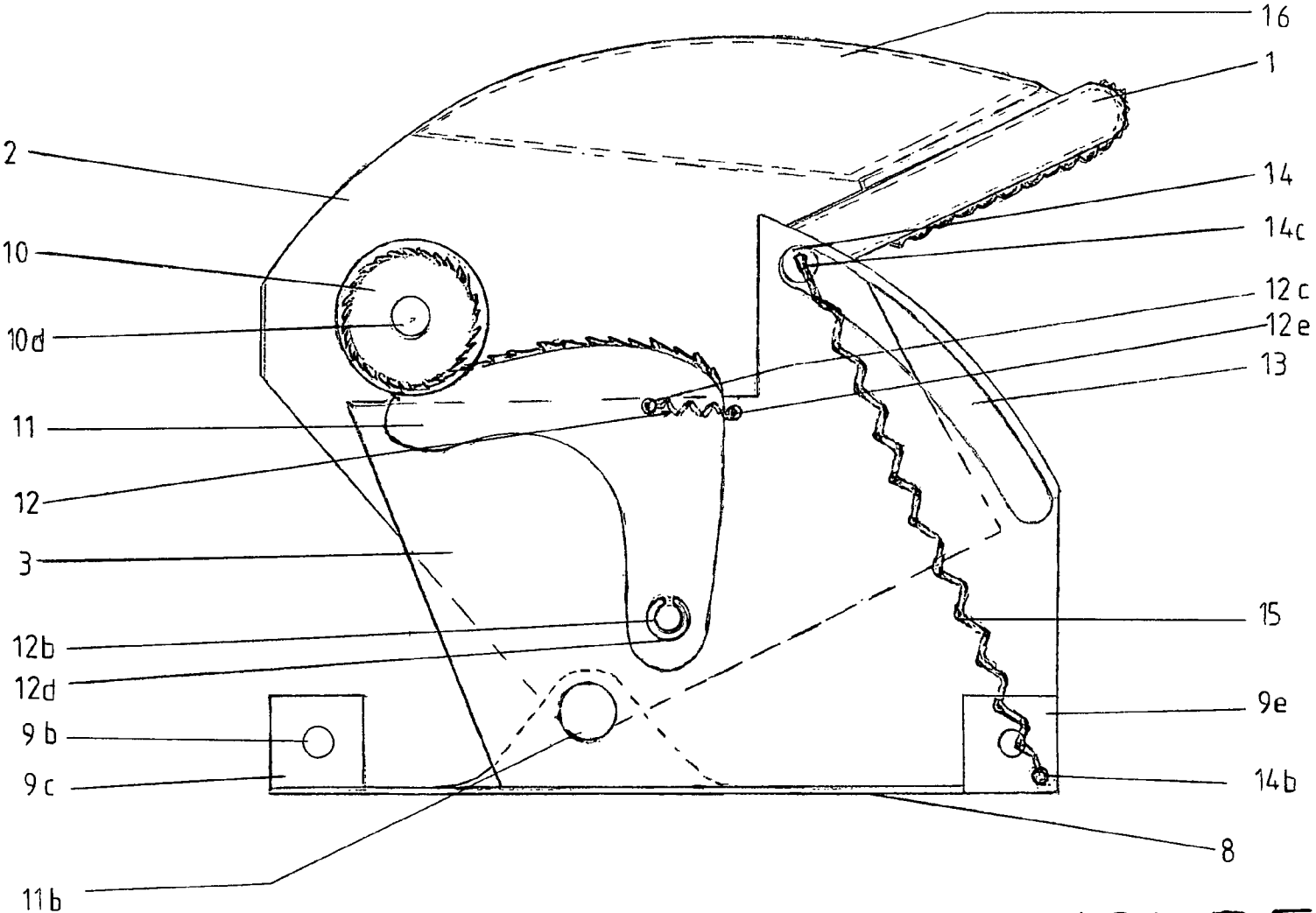
FIG. 3 DETAILED BASE PLAN VIEW OF THE FLAT HANDLE AND THE ADVANCING COMPONENTS

FIG. 3 shows the base view of the mechanism. Gear (10), whose teeth have large pressure angles, is part of the take-up spool (6), which runs on a ratchet gear lever (11) whose teeth have similar pressure angles as gear (10). The ratchet gear (11) is pushed against gear (10) by the tension in extension spring (12). The ratchet gear lever (11) is pivoted on the stud (12*b*) and is held in position by a retaining ring (12*d*) and can move freely about the axis of the stud. Peg (12*e*) restricts the movement of the ratchet lever and ensures correct engagement between the gears. The loop on extension spring (12) is hooked onto the recess on peg (12*e*) and its other end's loop is hooked onto the recess on pin (12*c*). The base-handle assembly (1) and (2) can move relative to the fixed flange (3) and is always in tension being pulled towards the mounting bracket (i.e. door) by the extension spring (15). This spring is hooked by its loop onto recess on pin (14*b*) on the flange and its other end's loop is hooked onto recess on pin (14*c*) on stud (14). The stud (14) can slide within slot (13) along flange (3) only through a predetermined subtended angle. This angle in turn determines the subtended angle through which the handle bar can travel back and forth and the stud (14) restricts the handle's movement through the set angle. When the handle is pulled, it comes to a dead stop in forward position after which any further force by hand will open the door. Upon release of the handle bar, it returns to its original resting (or backward) position by the tension in the spring.

Figure 4:
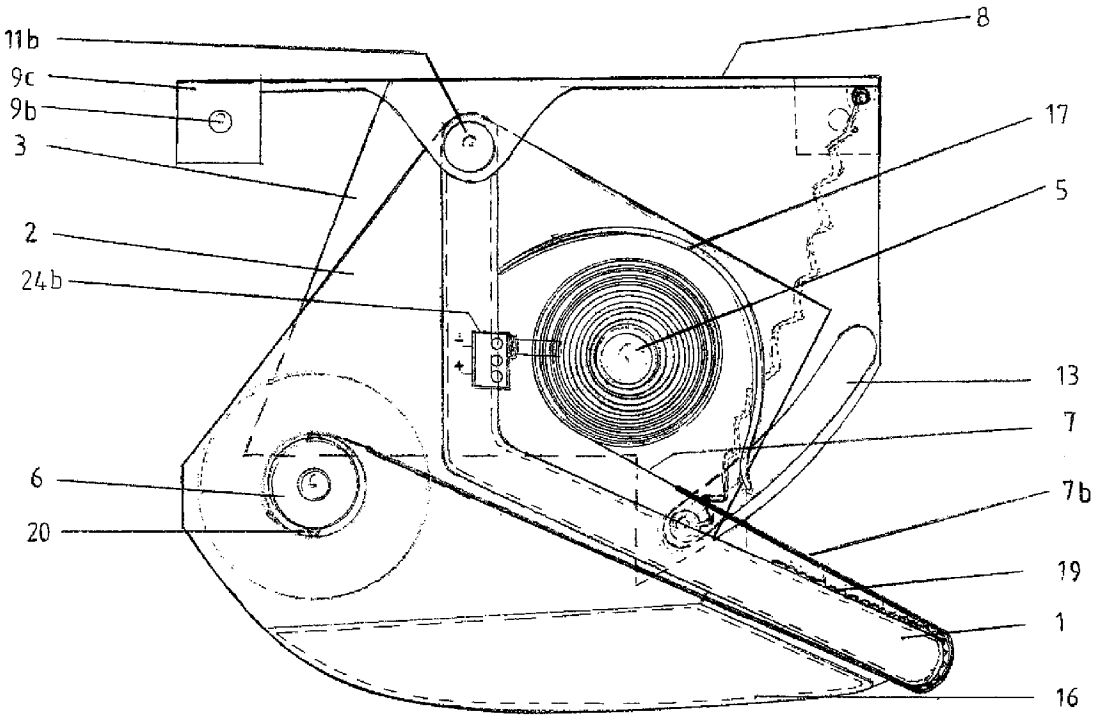
FIG. 4 DETAILED PLAN VIEW OF THE FLAT HANDLE, SPOOLS, HAND SHIELDS AND THE COMPONENTS

FIG. 4 shows the mechanism's plan view. The hand/fingers non-trap shield (16) is a formed thin plate whose shape is shown by way of example and is not limited to, and is attached to the base plate (2). As the name implies it protects the user's hand and fingers from coming into contact with the take-up spool (6) and the mechanism inside and guides user's hand to grasp onto the correct part for operating the handle. This will be explained more extensively later. The cylindrical shaped thin plate hand/fingers non-trap shield (17) is a similar protector whose shape is shown by way of example but is not limited to, and is attached to the base plate (2). It protects user's hands and fingers from coming into contact with the spool (5) and the components to the rear of the mechanism. Friction strip (19) is a width of grated metal or abrasive material of high frictional characteristic that is integrated along the edge of the flat handle bar (1) in the area most likely to be grasped by hand; its purpose is to create a non-slip surface between the paper/film and the flat handle bar while the user pulls or pushes against the paper/film hence preventing slack in the paper/film.

Figure 5:
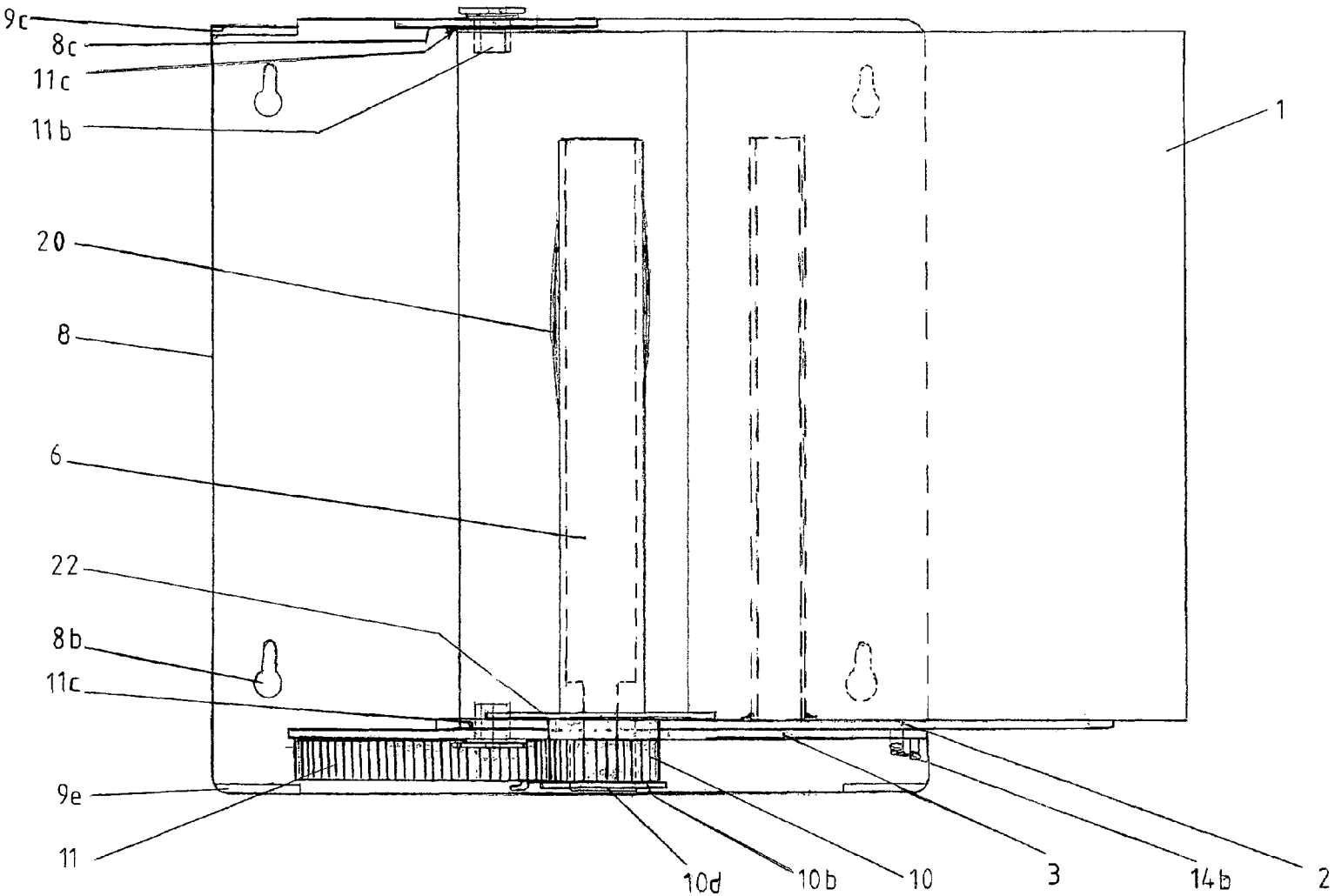
FIG. 5 DETAILED SIDE VIEW OF THE SPOOL DANCING MECHANISM

FIG. 5 shows the side view of the take-up spool mechanism. Flat door handle (1) is attached to the base plate (2) and, for extra strength, is pivoted on flange (3) and bracket flange (8*c*). For smooth rotation of the handle bar, slide bearings (11*b*) or similar bearings are used at the pivots. Washers (11*c*) placed between the handle bar and flanges ensure frictionless movement between the components. Take-up spool (6) that has thin inner wall is attached on a frictionless disc (22) that rests on the base plate (2) and is attached by interference fit to the gear (10) via protruded part of the spool (10*d*). The spool has a gradual sloppy protrusion (20) along about half of its height on each side that form a grip when the paper/film reel is loaded onto the spool. The presence of disc (22) also reduces the effect of cantilevering on the spool when the film/paper is under tension. Disc (10*b*) that is integral part of gear (10) prevents ratchet gear (11) from twisting whilst meshing with gear (10) and under load. This forms an assembly that rotates smoothly and freely. The feed spool (5) that has thin inner wall is permanently attached to the base plate (2) and excludes the features noted for the take-up spool (6). The paper/film reel can rotate freely on the feed spool.

The operation of the handle bar is now described in more detail. Referring to FIGS. 1,3 and 4, the paper/film reels consist of a feed reel with a length of the paper/film already attached to the blank take-up reel. The reels, which have different diameters (to avoid confusing one with the other when loading them), are initially dropped onto the appropriate take-up and feed spools (6 and 5). The paper/film is directed along the handle bar (1) and through the small gap between the handle bar and hand shield (16). To assist with loading, a short initial length of paper/film reel is made of thick material, as shown by 7*b* in FIG. 4. The casing's access port (23*b*), which is essentially a lid hinged to the front top of the casing is now closed and locked onto the mounting bracket by camlock (23*d*). To operate the mechanism, the user pulls on the flat handle bar (1) till it reaches the dead stop (or forward) position (this is about 30 to 40 degrees subtended angular movement on the handle bar which provides enough displacement of the paper/film in the area likely to be grasped by hand). During this action gear (10) pushes against ratchet lever (11) while moving but does not rotate because it does not engage with the latter; further pull on the handle will open the door, the user releases the handle bar and exits. The handle is spring loaded and returns to its original resting (backward) position, and during this movement gear (10) and ratchet lever (11) are engaged and the former's rotation (which is due to the handle returning to its resting position) forces the take-up spool (6) holding the take-up reel to rotate by a certain angle; this action consequently pulls a fresh length of paper/film from the feed reel on spool (5) and replaces the length of paper/film touched by the user, which is wound onto the take-up reel. The handle is now ready for the next user. The significance of the hand/fingers non-trap shields (16 and 17) now become apparent—they act as protection for hands and fingers from coming into contact with the paper/film reels and the mechanism inside; moreover, hand/fingers non-trap shield (16) ensures that the user grasps on the sanitary handle bar and not other protruding part(s) of the mechanism. Because of the design of the handle and its protruding part, any water/liquid remaining on the user's hand while touching the handle will drain downwards and away from the mechanism and through the casing's bottom opening.

Aperture (24) that is situated on the casing's access port (shown in FIG. 1) is used to inspect the amount of paper/film used or left on the reels, and can have graduation marks on the side so as to indicate when replacement of paper/film reel becomes necessary. Furthermore, markings on the final length of the paper/film being unrolled from the feed reel will be an indication of nearing the end of the paper/film on the feed reel. An additional mechanical switch (24*b*) with an arm lever can be attached to the handle bar near the feed spool (see FIG. 2). This switch is connected to a simple circuit consisting of a battery and a LED. The switch is normally open, but when the paper/film on the feed spool reaches near the end, the arm lever of the switch, which is lightly pressed against the paper/film, will close the circuit and hence illuminating the LED. The LED can be viewed through aperture (24) signalling the need to replace the reel. The paper/film reels can easily be replaced when needed in converse order to what has been described above.

With regards to the materials used for the construction of the parts, the internal components can be, but not limited to, single or mixture of metals and plastic-based materials depending on the strength and durability requirement. For example duracon or nylon can be used for the gears and spools. From aesthetic and hygiene point of view, the components exposed to hands such as the handle bar, hand/fingers shields and the outer casing can be constructed from stainless steel, chrome or high-grade aluminium or similar metals. The parts most likely to be vulnerable to any cross contamination by the used paper/film and hands can be coated with antimicrobial metallic material such as brass and silver that prevent bacteria growth. In all cases consideration will be given to the use of materials that will reduce overall weight. The paper/film used in reels can be of ultra-thin non-absorbing biodegradable high-density polyethylene or similar material.

It should be mentioned that for it to function correctly and from ergonomics point of view, the mechanism, as shown on the foregoing figures, is suitable for a door with hinge(s) located to the left of the handle. However, the mechanism can be mounted on a door as shown but having been rotated clockwise by ninety degrees, without impeding its internal operation. If mounted in this position, the handle bar is pulled from below (i.e. about a horizontal axis as opposed to from the side). In a different embodiment, the mechanism can be manufactured so the components are assembled in a mirror-like manner to what has been described herein and shown in the figures, which can suit mounting the handle on a right-hinged door.

The described door handle mechanism will be suitable for most doors used in practice. However, because the door handle advancing mechanism is spring loaded, the load resisting its action must be greater than that of the mechanism itself. Therefore, for the mechanism to operate properly, the door that the handle is to be fitted on should be loaded accordingly.

The invention described above is suitable for attachment onto a door without a latch. In a similar embodiment to that described in this invention, the mechanism can incorporate a simple link to a door latch lever so that the latch can be operated when the handle bar is pulled and released.

The aforementioned is the description of an invention for a flat sanitary door handle with a mechanical continuous paper/film advancing mechanism manually operated by the hand of the user without external source of power. The design of the invention is not limited thereto and can include additional features and modifications falling within the context and scope described in the claims.

The invention claimed is:

1. A flat sanitary door handle mechanism comprising:

a flat handle having two opposite sides with a usable side having an area that is graspable by hand and facing a door, the flat handle having a flat surface, wherein the flat handle is attached to a base plate pivoted on a flange of a mounting bracket;

a rotatable fresh sanitary material feed spool and a rotatable take-up spool of different structural diameter to enable the two spools to be distinguishable, wherein both of the two spools are mounted separately on the same base plate as the flat handle, one spool to each opposite side of the flat handle, each having separate parallel axes of rotation, and wherein the two spools are also mounted on the same base plate that is pivoted on the flange of the mounting bracket;

a mechanical manually operated material advancing mechanism configured for resupplying the flat handle with fresh sanitary material by pulling a length of the sanitary material from the feed spool each time the flat handle is pulled away from a door surface and released through a displacement angle relative to the mounting bracket, as pivoted on the mounting bracket, by replacing used material in the area of the flat handle that is graspable by hand; and a casing that is fixed to the mounting bracket and encloses the material advancing mechanism and the two material spools configured such that only a usable portion of the flat handle, which includes the usable side with the area that is graspable by hand, is protruded from the casing, wherein the flat handle and the base plate are configured to operate the material advancing mechanism when the flat handle is pulled away from the door surface and released through the displacement angle whereby the flat handle, the two spools, and the base plate are moved through the displacement angle, relative to the fixed casing, by being pivoted on the flange;

wherein the sanitary material on the feed spool and the used material on the take-up spool are a continuous length of a flat paper/film that is fed to an outside surface of the usable side with the area that is graspable by hand and the flat paper/film goes around an end of the flat handle that is distal from where the flat handle is pivoted on the flange of the mounting bracket to form a barrier between a hand of a user and the opposite sides of the flat handle; and wherein the flat sanitary door handle mechanism is configured for being attached by the mounting bracket on a pull door either with an axis of rotation of the flat handle parallel with respect to a pivot axis of the door or perpendicular to the pivot axis of the door, depending on the ease of operation desired, with the axis of rotation of the flat handle being parallel to the flat surface of the door to which the mechanism is attached.

2. The flat sanitary door handle mechanism as per claim 1 wherein two hand/finger non-trap shields are mounted on the same base plate as the flat handle, one shield to each of the opposite sides of the flat handle, which are pivoted on the flange of the mounting bracket to protect a user's hand/fingers from coming into contact with the feed and take-up spools and to guide the user's hand to the usable side of the flat handle.

3. The flat sanitary door handle mechanism as per claim 2 wherein the two non-trap hand/finger shields and the feed and take-up spools are mounted on the same base plate as the flat handle to form one combined assembly that is configured to rotate about a pivot axis of the base plate that is parallel to the mounting bracket and a surface of a door to the which the mounting bracket is attachable.

4. The flat sanitary door handle mechanism as per claim 1 wherein a continuous thin length of sanitary flat paper/film material is wound on the spools, which has a substantially thicker initial length to assist with loading the continuous thin length of sanitary flat paper/film material on the handle.

5. The flat sanitary door handle mechanism as per claim 4 wherein a frictional strip is positioned along the edge of the flat handle in an area most likely to be grasped by a user's hand to create a non-slip friction area between the flat paper/film and the flat handle to prevent slip and slack in the flat paper/film when grasped by the user's hand.

* * * * *